US006824394B1

(12) United States Patent
Brundage

(10) Patent No.: US 6,824,394 B1
(45) Date of Patent: Nov. 30, 2004

(54) MODULAR SENSOR SYSTEMS WITH ELASTOMERIC CONNECTORS

(75) Inventor: Gary L. Brundage, Martinez, CA (US)

(73) Assignee: Phionics, Inc., Martinez, CA (US)

( * ) Notice: Subject to any disclaimer, the term of this patent is extended or adjusted under 35 U.S.C. 154(b) by 0 days.

(21) Appl. No.: 10/612,236

(22) Filed: Jul. 1, 2003

(51) Int. Cl.[7] ..... H01R 9/09
(52) U.S. Cl. ..... 439/65; 439/91
(58) Field of Search ..... 439/65, 91, 74, 439/75, 61, 161, 260, 267, 66

(56) References Cited

U.S. PATENT DOCUMENTS

| | | | | | |
|---|---|---|---|---|---|
| 3,038,138 | A | | 6/1962 | Peterson | 439/21 |
| 3,479,632 | A | | 11/1969 | Galles | 439/21 |
| 3,599,165 | A | | 8/1971 | Wendell et al. | 339/5 |
| 3,972,577 | A | | 8/1976 | Charles et al. | 439/21 |
| 4,590,337 | A | | 5/1986 | Engelmore | 179/186 |
| 4,838,798 | A | * | 6/1989 | Evans et al. | 439/61 |
| 4,904,190 | A | | 2/1990 | Plocek et al. | 439/15 |
| 4,922,191 | A | * | 5/1990 | Conover | 324/755 |
| 4,988,963 | A | | 1/1991 | Shirosaka et al. | 439/21 |
| 5,009,604 | A | | 4/1991 | Plocek et al. | 439/15 |
| 5,122,064 | A | * | 6/1992 | Zarreii | 439/65 |
| 5,173,053 | A | | 12/1992 | Swanson | 439/27 |
| 5,211,565 | A | * | 5/1993 | Krajewski et al. | 439/65 |
| 5,350,308 | A | | 9/1994 | Laska et al. | 439/91 |
| 5,363,690 | A | | 11/1994 | Evangelista et al. | 73/31.05 |
| 5,399,093 | A | | 3/1995 | Schneider et al. | 439/21 |
| 5,551,882 | A | | 9/1996 | Whiteman et al. | 439/21 |
| 5,588,843 | A | | 12/1996 | Sobhani | 439/22 |
| 5,690,498 | A | | 11/1997 | Sobhani | 439/22 |
| 5,704,792 | A | | 1/1998 | Sobhani | 439/21 |
| 5,746,606 | A | | 5/1998 | Sobhani | 439/21 |
| 5,899,753 | A | | 5/1999 | Wong et al. | 439/17 |
| 5,910,640 | A | * | 6/1999 | Farnworth et al. | 174/50 |
| 6,305,944 | B1 | | 10/2001 | Henry et al. | 439/22 |
| 6,324,071 | B2 | * | 11/2001 | Weber et al. | 361/785 |
| 6,328,572 | B1 | * | 12/2001 | Higashida et al. | 436/61 |
| 6,331,117 | B1 | | 12/2001 | Brundage | 439/21 |
| 6,418,034 | B1 | * | 7/2002 | Weber et al. | 361/790 |
| 6,508,675 | B1 | * | 1/2003 | Korsunsky et al. | 439/637 |
| 6,705,877 | B1 | * | 3/2004 | Li et al. | 439/74 |

OTHER PUBLICATIONS

U.S. Department of Defense, Small Business Innovation Research (SBIR) Program Project Summary (Phase I). Topic No.: A94–091. Proposal Title, "In–Situ Electronic Sensors to Determine Analytes in Cold–Regions Soils," date Jul. 1994. 12 pages (Appendix A, Appendix B and pp. 1–10).

U.S. Department of Defense, Small Business Innovation Research (SBIR) Program Project Summary (Phase II). Topic No.: A94–091. Proposal Title "In–Situ Electronic Sensors to Determine Analytes in Cold–Regions Soils," dated Sep. 1995. 14 pages (Appendix A, Appendix B and pp. 1–12).

(List continued on next page.)

*Primary Examiner*—Ross Gushi
*Assistant Examiner*—Phuongchi Nguyen
(74) *Attorney, Agent, or Firm*—Silicon Edge Law Group LLP; Arthur J. Behiel

(57) ABSTRACT

Described are modular water sensors designed to speed assembly and otherwise improve manufacturability. Various sensors, modules, and cables communicate via connector systems that employ elastomeric conductors to establish and maintain electrical contact between perpendicular wiring-board surfaces. The elastomeric conductors are held in place using easily assembled systems of clips and retainers.

20 Claims, 9 Drawing Sheets

OTHER PUBLICATIONS

Solicitation, Offer and Award, Contract No. DACA39–95–C–0029, dated Mar. 1995. Includes: Section B, supplies or Services and Prices/Costs; Section C, Description/Specs./Work Statement; Section E, Inspection and Acceptance; Section F, Deliveries or Performance; Section H, Special Contract Requirements; Section I, Contract Clauses; Section J, List of Attachments; Section K, Representations, Certifications and Other Statements of Offerors; and Section L, Instrs., Conds., and Notices to Offerors. 98 pages, (A–1, B–1, C–1, E–1, F–1 to F–2, H–1, I–1 to I–71, J–1, K–1 to K–15, L–1 to L–4).

Solicitation, Offer and Award, Contract No. DACA39–96–C–0022, dated Apr. 1996. Includes: Section B, Supplies or Services and Prices/Costs; Section C, Description/Specs./Work Statement; Section E, Inspection and Acceptance; Section F, Deliveries or Performance; Section H, Special Contract Requirements; Index of Clauses Section I; Section I, Contract Clauses; Section J, List of Attachments; Section K, Representations, Certifications and Other Statements of Offerors; Section L, Instrs., Conds., and Notices to Offerors; and Letter from Ruth C. Little Contract Specialist/Contracting Officer. 172 pages, (A–1, B–1, C–1, E–1, F–1, H–1 to H–3, I–TC–1 to I–TC–3, I–1 to I–128, J–1, K–1 to K–28, L–1 to L–3 and 1 page letter).

Copy of E–Mail from Gary Brundage to Steve Grant (Cc: Mike Reynolds and Sharon Borland), dated May 6, 1997. Subject: Shipment of prototypes (NO3 and O2). 1 page.

Copy of E–Mail from Gary Brundage to Sharon Borland (Cc: Steve Grant and Mike Reynolds), dated May 22, 1997. Subject: Progress Report on Contract No.: DACA39–96–C–0022 for the period Apr. 21, 1996 to May 20, 1996. 1 page.

Copy of E–Mail from Gary Brundage to Sharon Borland (Cc: Steve Grant and Mike Reynolds), dated Jul. 20, 1997. Subject: Progress Report on Contract No.: DACA39–96–C–0022 for the period Jun. 21, 1997 to Jul. 20, 1997. 2 pages.

Catalog entitled, "Electronic Packaging Components, ZEBRA®, Elastomeric Connectors, RFI/EMI Shielding & ESD Grounding, Thermal Management Components, and Custom Silicon Moldings, Extrusions," Fujipoly® (1996).

* cited by examiner

MODULAR SENSOR SYSTEMS WITH ELASTOMERIC CONNECTORS

BACKGROUND

Growing environmental consciousness and a corresponding body of law place ever-increasing emphasis on maintaining water quality in lakes, streams, and groundwater. Due to this emphasis, there is a growing market for systems capable of monitoring various physical and chemical properties of water resources. A sampling of the parameters of interest includes conductivity, dissolved-oxygen concentration, oxygen-reduction potential (ORP), pH, temperature, depth, and specific ion concentrations.

Surface-water data is typically collected using immersed sensors. Collecting groundwater data can be more troublesome, often requiring that wells be drilled for sensor insertion. Drilling wells is expensive, but minimizing bore diameter can reduce the cost. Sensors for use in wells are therefore made to have relatively small diameters. For a detailed description of typical sensors, see U.S. Pat. No. 6,305,944 to Henry et al., which is incorporated herein by reference.

While smaller sensor systems are desirable from the end-user's perspective, smaller systems are generally more difficult and expensive to build and maintain. There is therefore a need for small, reliable sensor systems that are easily assembled and maintained.

FIG. 1 (prior art) is an exploded view of a system 100 that can be adapted for monitoring water quality in e.g. lakes, rivers, ponds, tanks, and groundwater. System 100 is detailed in U.S. Pat. No. 6,331,117 B1 issued to Gary L. Brundage, which is incorporated herein by reference.

System 100 includes a pair of circuit modules 110 and 120 disposed between connector supports 125 and 130, respectively. Module 120 includes printed circuit boards 122A and 122B each having respective integrated circuits 124A and 124B. A conductive member 135 is disposed between wiring boards 140A and 140B of respective circuit modules 110 and 120. System 100 is completed when a component housing 145, typically a stainless-steel tube, is threaded onto each of connector supports 125 and 130. A pair of dimples 150 and 155, pressed into the side of component housing 145, create corresponding protrusions on the inside surface of component housing 145. These protrusions mate with threads 160 and 165 to secure respective connector supports 125 and 130 to component housing 145. As compared with other types of machine threads, dimples 150 and 155 are relatively easily and inexpensively formed.

Once system 100 is assembled, spring 170 exerts a compressive force on a stack of circuit components, including circuit modules 110 and 120 and conductive member 135. This compressive force ensures excellent electrical contact between opposing wiring boards (e.g., boards 140D and 140E).

Each circuit module 110 and 120 can be virtually any type of electrical circuit. Being arranged as they are, components 110 and 120 can be removed and replaced as easily as batteries in a flashlight. Moreover, component housing 145 can be substituted with a longer or shorter housing to accommodate more or fewer electrical components or to accommodate components of different sizes. Dummy components can be inserted to allow room for future additions. For example, a particular system may be adapted for use where no power supply is readily available by substituting a dummy component with a battery-pack module.

System 100 can support a number of applications. Sensor 175 may be, for example, an ion sensor for monitoring ground water, a thermometer, a microphone, a video camera, or any of a variety of other conventional transducers. In one embodiment, sensor 175 is a pH sensor for monitoring groundwater acidity or alkalinity, circuit module 120 is a differential amplifier configured to amplify an output signal from sensor 175, and circuit module 110 is a transmitter that transmits versions of signals received from module 120 via cable 180. This system is easily adapted for used as e.g. a pressure sensor by installing an appropriate pressure transducer/pre-amplifier combination as sensor 175 and module 120. Alternatively, the above-described pH sensor can be adapted to transmit signals in compliance with different communication standards by substituting the module 110 for a different type of transmitter. Many permutations are possible, as will be obvious to those of skill in the art.

The order and orientation of the various modules can be critical to system function. Some systems may therefore include modules that can only be installed in a particular orientation, thus ensuring that the systems cannot be assembled improperly. For example, wiring board 140D of system 100 is smaller in diameter than wiring board 140B so that circuit module 120 cannot contact wiring board 140E should circuit module 120 be installed backwards. For more information and details on system 100, see the above-referenced patent to Brundage.

The modularity of system 100 advantageously reduces required inventory by supporting a large number of common parts among a relatively large number of applications. This advantage is further enhanced by the system's ease of assembly: instead of having a fixed number of each of many types of sensors on hand to fill orders quickly, a manufacturer can fill a particular customer requirement from stock by combining appropriate modules. Despite these advantages, there is an ever-present demand for systems and methods that speed assembly and otherwise improve manufacturability without sacrificing quality or performance.

DETAILED DESCRIPTION

The present invention addresses the demand for systems and methods that speed assembly and otherwise improve manufacturability without sacrificing quality or performance. The novel systems and methods are described with reference to modular groundwater sensor assemblies, but are not limited to such systems.

Figure 1:
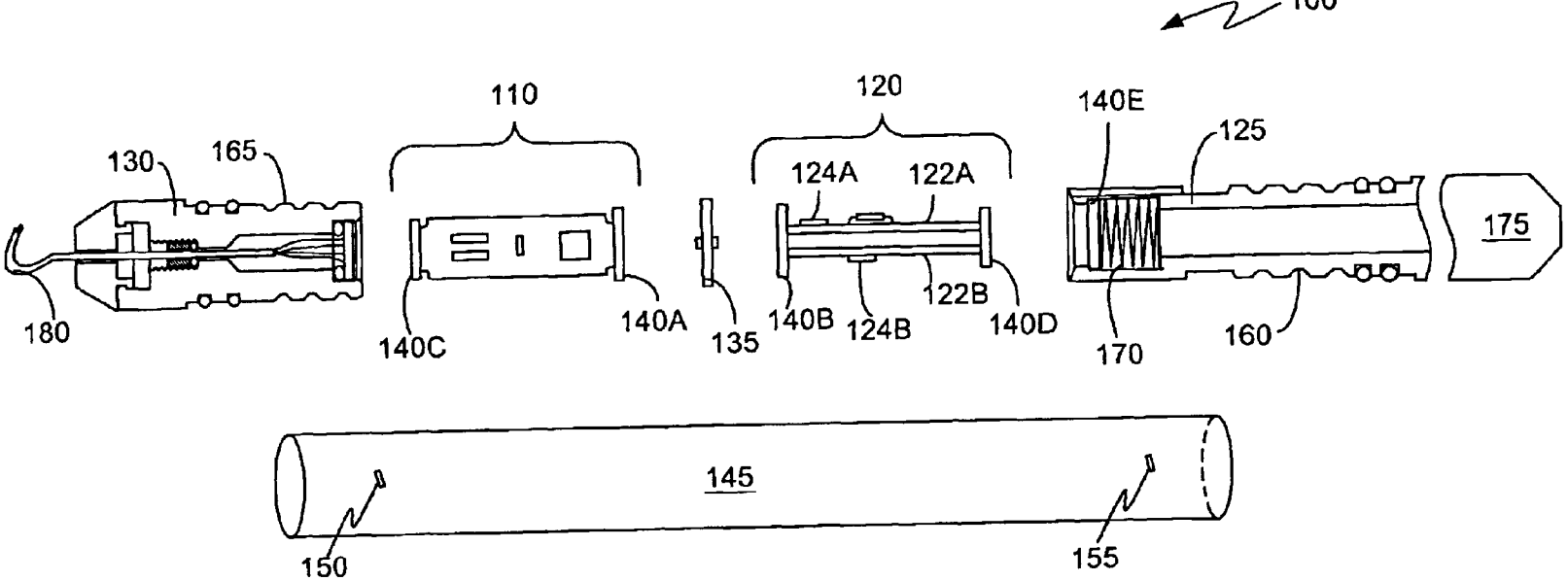
FIG. 1 (PRIOR ART)
FIG. 1 (prior art) is an exploded view of a system 100 that can be adapted for monitoring water quality in e.g. lakes, rivers, ponds, tanks, and groundwater.
Figure 2A:
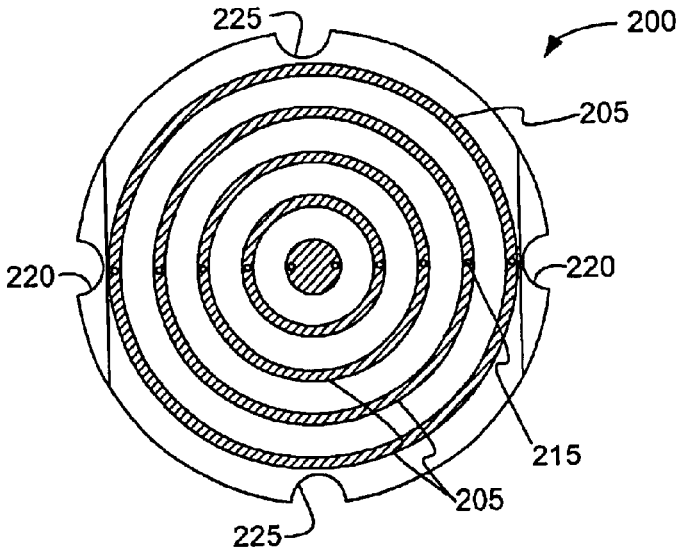
FIGS. 2A–2C depict a wiring board 200 in accordance with one embodiment.
Figure 2B:
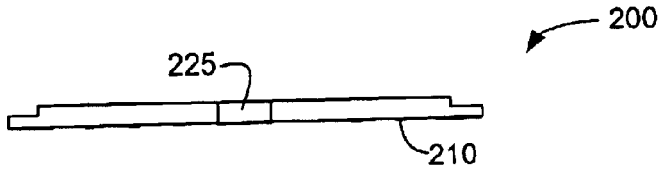
Figure 2C:
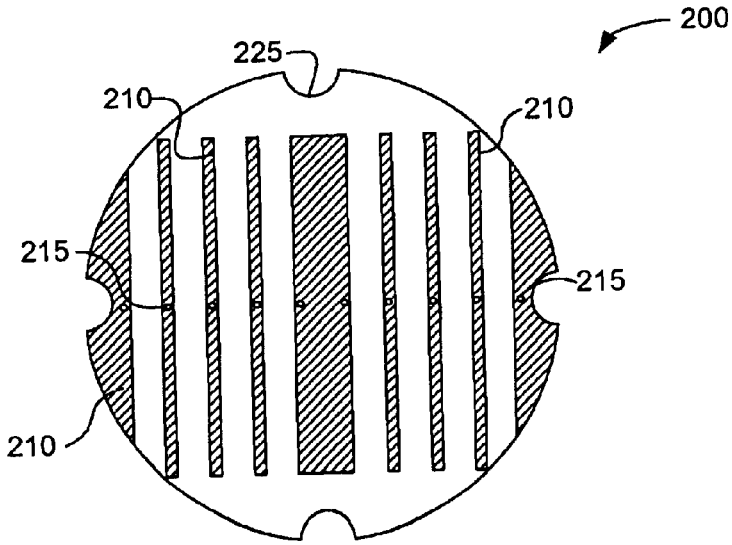

FIGS. 2A–2C depict a wiring board 200 that serves as a connector half in accordance with one embodiment. Wiring board 200 easily attaches to a number of electrical components to provide for external connectivity. FIG. 2A is a plan view of a first surface of wiring board 200, including a plurality of concentric conductors 205 disposed on an insulating substrate; FIG. 2B is a side view; and FIG. 2C is a plan view of a second surface, including a plurality of conductors 210 electrically connected to conductors 205 by a plurality of vias 215. A first pair of indentations 220 accept a clip, as noted below, and a second pair of indentations 225 allow clearance for moving wiring board 200 past some protrusions, similar to dimples 150 of FIG. 1, during installation.

Figure 3:
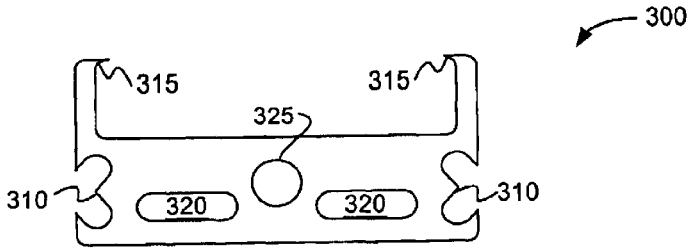
FIG. 3 is a plan view of an elastomeric support 300, a clip in the depicted embodiment, for attaching wiring board 200 to a second wiring board.

FIG. 3 is a plan view of an elastomeric support 300, a clip in the depicted embodiment, for attaching wiring board 200 to a second wiring board. Clip 300 is of an insulating material, such as DELRIN, and in this embodiment includes a pair of bays 310, clip ends 315, a pair of slots 320, and a hole 325.

Figure 4A:
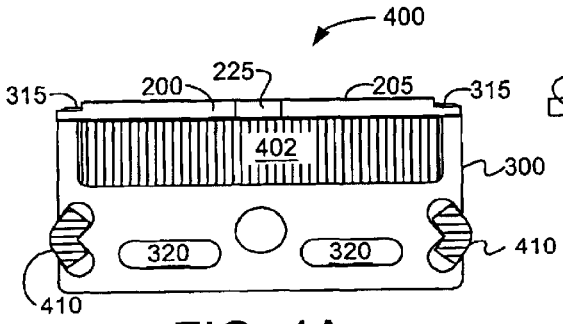
FIGS. 4A and 4B are front and side views, respectively, of a connector system 400 in which clip 300 of FIG. 3 is attached to wiring board 200 of FIG. 2.
Figure 4B:
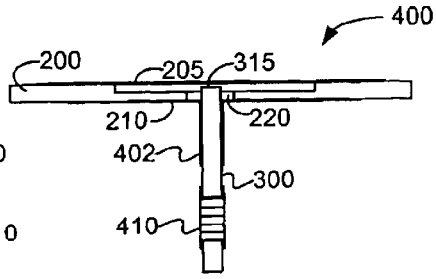

FIG. 4A depicts a connector system 400 in which clip 300 of FIG. 3 is attached to wiring board 200 of FIG. 2; FIG. 4B depicts the same connector system 400 from the side. A length of elastomeric conductor 402 is disposed between clip 300 and the bottom surface of wiring board 200, and a pair of elastomeric conductors 410 are press fitted into respective bays 310. Elastomeric conductor 402 conducts electricity in a direction normal to the page and normal to the bottom surface of wiring board 200, but does not conduct electricity in a direction illustrated as from left to right in FIG. 4A. Elastomeric conductors 410 conduct electricity in a direction normal to the page and from left to right, but do not conduct electricity normal to the bottom surface of wiring board 200; however, elastomeric conductors 410 need not be non-conductive in any direction for purposes of the depicted embodiment. Suitable elastomeric conductors are available from Fujipoli of Cranford, N.J., under the trademark ZEBRA. Elastomeric conductors employing strips of gold wrapper around a silicone substrate are relatively expensive but provide low-impedance, corrosion-resistant contacts. Other flexible, directionally conductive materials might also be used.

Conductors 205 on the top surface of wiring board 200 are concentric to provide rotational contact, but need not be concentric in embodiments that do not support rotational connections. Conductors 210 on the other side of wiring board 200 are not concentric, but can be in other embodiments. For example, clip 300 can be replaced with a support that does not require a particular wiring board orientation; e.g., a support can be attached to the periphery of wiring board 200 or through a hole in the center of wiring board 200 in a manner that allows wiring board 200 to rotate on its axis.

Figure 5A:
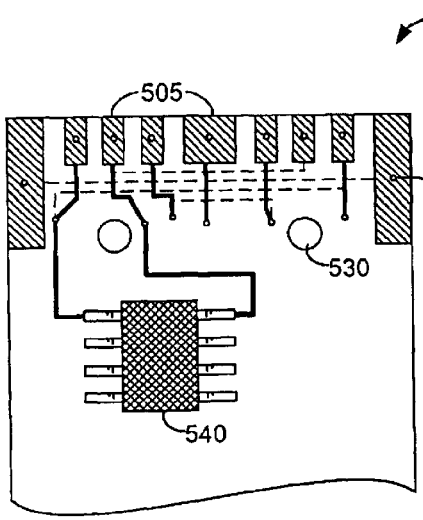
FIGS. 5A and 5B depict alternate sides of a printed circuit board (PCB) 500 adapted for use with connector system 400 of FIGS. 4A and 4B.
Figure 5B:
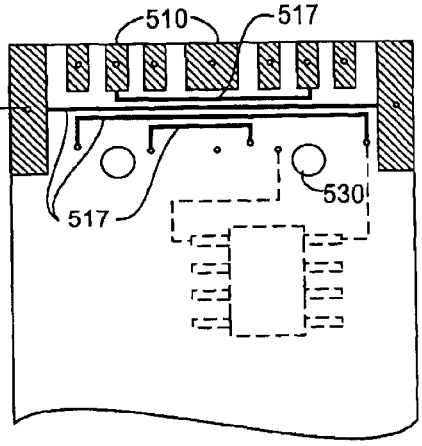

FIGS. 5A and 5B depict alternate sides of a printed circuit board (PCB) 500 adapted for use with connector system 400 of FIGS. 4A and 4B. PCB 500 includes a plurality of pads 505 extending along an edge, each pad 505 corresponding to one of conductors 210 on the second side of wiring board 200 (FIG. 2C). The opposite side of PCB 500' also includes a plurality of pads 510. In this embodiment, each pad 510 connects to a corresponding one of pads 505 by way of a corresponding via 515. The pad configurations on each side of board 500 are bilaterally symmetrical. In this embodiment, traces 517 connect symmetrical pairs of pads so that the symmetry is electrical as well as physical.

Figure 6A:
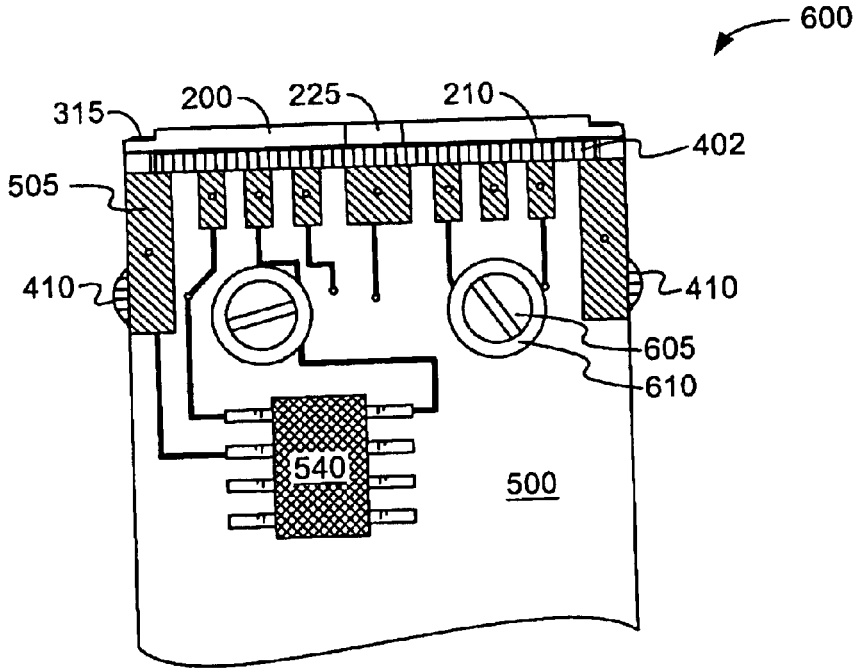
FIGS. 6A and 6B depict views of a circuit module 600, including a pair of PCBs 500 (FIGS. 5A and 5B) mounted to a connector system 400 (FIGS. 4A and 4B).
Figure 6B:
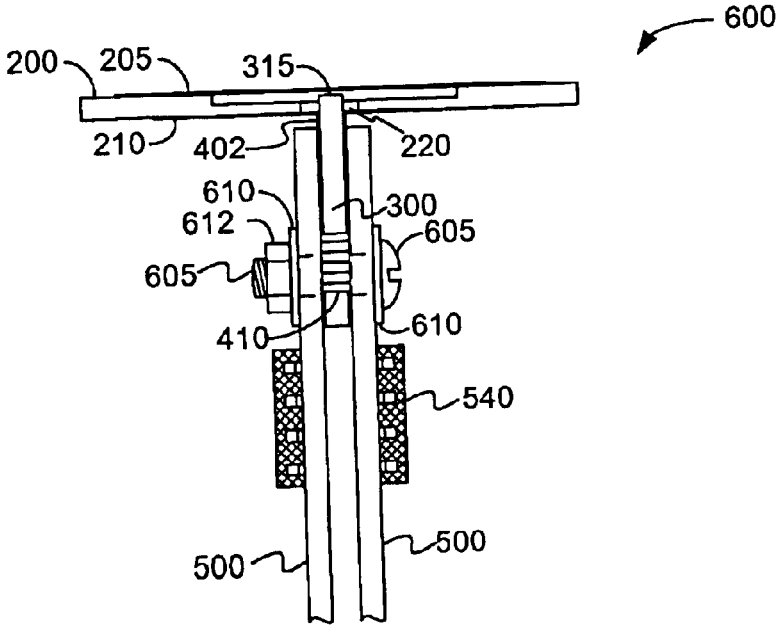

FIGS. 6A and 6B depict views of a circuit module 600, including a pair of PCBs 500 (FIGS. 5A and 5B) mounted to a connector system 400 (FIGS. 4A and 4B). Each of a pair of fasteners 605 (e.g., screws or rivets) extends through a hole 530 in boards 500, a slot 320 in clip 300, a pair of washers 610, and a nut 612. This hardware is fastened so the pads on one side of each board 500 contact elastomeric conductors 402 and 410. In selecting the materials and arrangement of fasteners 605, care should be taken to prevent short circuits on the associated wiring boards. In one embodiment in which hole 530 is relatively close to wiring-board traces, washers 610 are of TEFLON.

Returning briefly to FIG. 3, wiring boards with concentric conductors may be fastened to clip 300 via a single fastener through hole 325 and corresponding holes in the associated PCBs. The fastener could be tight enough to provide secure electrical connections but loose enough to allow the wiring board to pivot with respect to the PCBs. Connectors thus formed are self-leveling. In other embodiments, the ones of hole 325 and slots 320 not used to secure boards to clip 300 can support elastomeric conductors that extend between opposing boards in the manner of conductors 410. Spherical elastomeric conductors might be, suitable for some such embodiments.

In the example of FIGS. 6A and 6B, pads 510 (FIG. 5B) contact the elastomeric conductors, but board 500 might also be flipped over so that pads 505 provide the requisite electrical contact. The physical and electrical symmetry of boards 500 reduce the possibility of assembly errors because boards 500 can be positioned with either side against clip 300. Boards 500 may provide the same or different functionality.

As noted above, elastomeric 402 does not conduct electricity in a direction from left to right, or vice versa. Pads 505 and 510 are thus connected to respective conductors 210 on the bottom of wiring board 200 but are electrically isolated from one another. Components on wiring board 500 (e.g. IC 540) can therefore communicate electrical signals to external components (not shown) via the concentric rings 205 of wiring board 200 (FIG. 2A). Due to the symmetry of the pads on wiring board 500, elastomeric 402 can be made to extend across only half of wiring board 200. Clip 300 can be modified to accommodate the shorter elastomeric. Such connections require a shorter length of elastomeric conductor, and are therefore less expensive.

The second wiring board 500 illustrates how module 600 can be expanded to include more than one PCB. Additional PCBs can likewise be stacked to further increase the amount of board space without appreciably increasing the length or cross-sectional area of module 600. Support 300 safely and simply interconnects PCBs 500 and wiring board 200.

Figure 7A:
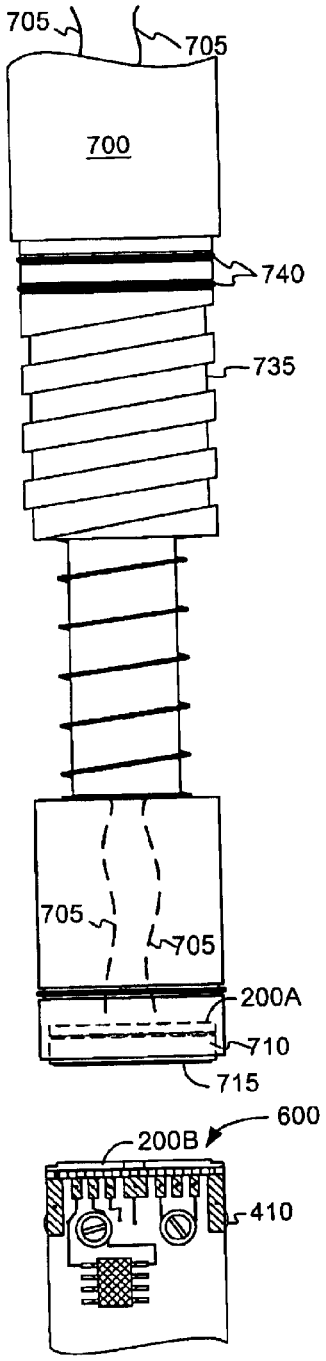
FIGS. 7A–7C depict an example of how module 600 can communicate with a sensor housing 700.
Figure 7B:
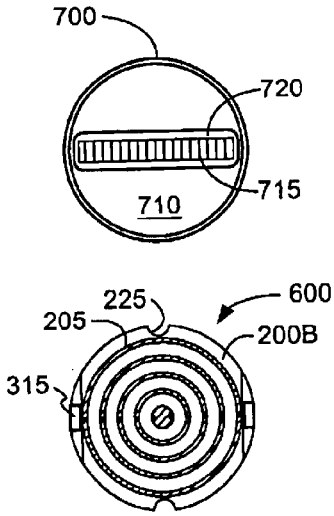
Figure 7C:
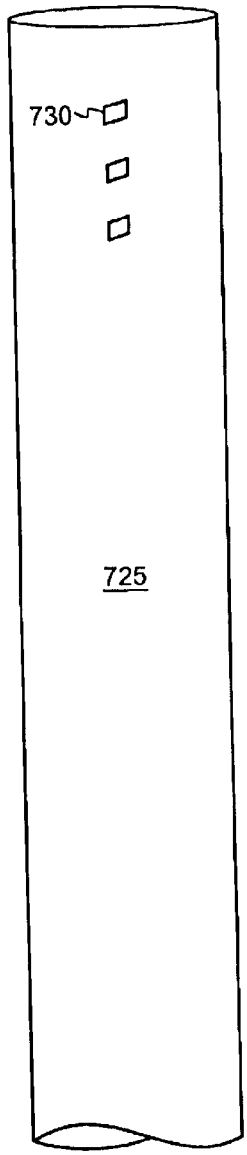

FIGS. 7A–7C depict an example of how module 600 can communicate with a sensor housing 700. Sensor housing 700 might include one or more of a number of types of sensors (not shown), such as those that produce a measure of pressure, temperature, pH, oxidation-reduction potential, dissolved oxygen, specific ion concentrations, or a combination of one or more of these. Whatever the sensor(s), in this example the sensor communicates signals via a pair of wires 705. Each of wires 705 is soldered or otherwise connected to conductors 210 of a wiring board 200A similar to wiring board 200 of FIGS. 2A–2C. A circular, insulating retainer 710 disposed across the face of wiring board 200A includes a slot supporting a length of elastomeric conductor 715. Elastomeric conductor 715 extends through retainer 710 to make contact with each concentric conductor 205 of wiring board 200A and with the corresponding concentric conductors on the surface of a second wiring board 200B, also similar to wiring board 200 of FIGS. 2A–2C.

FIG. 7B depicts the top surface of wiring board 200B of module 600 and the bottom surface of sensor housing 700, including retainer 710 and elastomeric conductor 715. Retainer 710 includes a recess 720 surrounding elastomeric conductor 715. Recess 720 prevents elastomeric conductor 715 from being overly compressed, and consequently reduces wear and increases the life of elastomeric conductor 715. The radial symmetry of concentric conductors 205 on wiring board 200B allows sensor housing 700 and module 600 to rotate relative to one another, during assembly, for example.

FIG. 7C depicts a module housing 725 that rotatably attaches to sensor housing 700. One or more dimples 730 mate with threads 735 on sensor housing 700. Dual O-rings 740 provide a watertight seal between sensor housing 700 and module housing 725. In the depicted embodiment, module housing 725 is conductive, for example, is of stainless steel or titanium. Elastomeric conductors 410 extend from the sides of module 600 to make physical and electrical contact with the inside surfaces of housing 725 when module 600 is installed. Bays 310, detailed in FIG. 3, hold elastomeric conductor 410 in a shape that facilitate insertion of module 600 into housing 725. Elastomeric conductors 410 thus connect module 600 to e.g. earth ground or solution ground. Slots 225, discussed above in connection with FIG. 2A, allow module 600 to bypass interior protrusions formed by one or more dimples 730, and thus facilitate assembly.

Figure 8A:
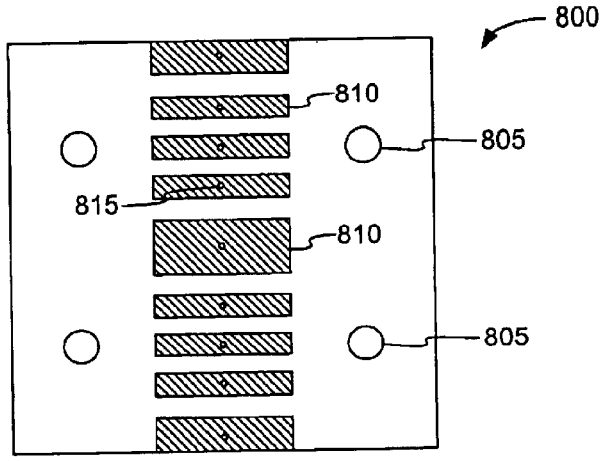
FIGS. 8A and 8B depict a manner of combining a plurality of modules 600 in accordance with another embodiment.
Figure 8B:
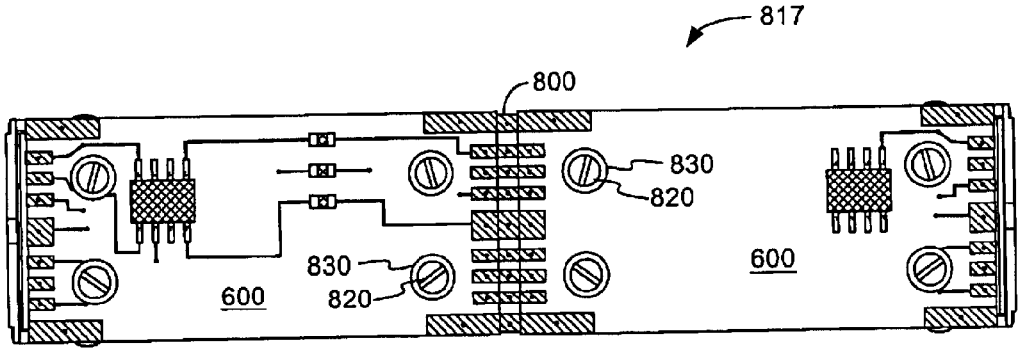

FIGS. 8A and 8B depict a manner of combining a plurality of modules 600 in accordance with another embodiment. FIG. 8A depicts a symmetrical wiring board 800 that includes a number of holes 805 and pads 810. Similar pads on the opposite side (not shown) are connected to pads 810 using a collection of respective vias 815. FIG. 8B depicts a multi-module system 817 in which two modules 600 are interconnected using board 800 of FIG. 8A. Fasteners 820 and respective non-conductive washers 830 extend through holes in modules 600 and holes 805 in board 800 so pads 810 of board 800 provide electrical connection between the corresponding pads on modules 600. The assembly of FIG. 8B can be soldered, but this is not required. This example shows two modules connected together, but the system may include more or fewer. Further, wiring board 800 need not be reversible or symmetrical, and one or more of vias 815 may be omitted to allow different signals on opposite board traces.

Figure 9:
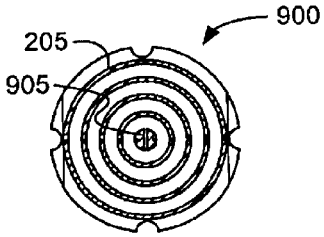
FIG. 9 depicts a wiring board 900 in accordance with an embodiment that includes a split conductor 905 having two electrically isolated portions.

FIG. 9 depicts a wiring board 900 in accordance with an embodiment that includes a split conductor 905 having two electrically isolated portions (the respective conductor 210 on the opposite side is similarly split). The two portions remain electrically isolated until wiring board 900 is brought into contact with another connector half, e.g. another similar wiring board or an elastomeric disk or strip. This embodiment is useful, for example, for modules that include batteries and battery-powered components. One power terminal of the battery module might be connected to the battery-powered components via the split conductor 905. The battery-powered modules thus remain disconnected from the battery until the system is assembled, advantageously increasing module shelf life. An exemplary embodiment is discussed below in connection with FIG. 14.

Figure 10:
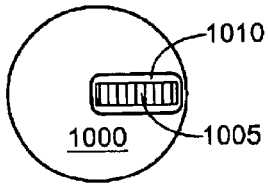
FIG. 10 depicts an embodiment of a retainer 1000 supporting a length of elastomeric conductor 1005.

FIG. 10 depicts an embodiment of a retainer 1000 supporting a length of elastomeric conductor 1005. Retainer 1000 includes a slot supporting elastomeric conductor 1005 and a recess 1010 allowing conductor 1005 to expand under pressure. Quality elastomeric conductors are expensive, so conductor 1005 is limited to about half the diameter of an associated wiring-board surface to reduce cost. In other embodiments, a disk of elastomeric material is used in place of retainer 1000 and elastomeric conductor 1005.

Figures 11A, 11B, 11C:
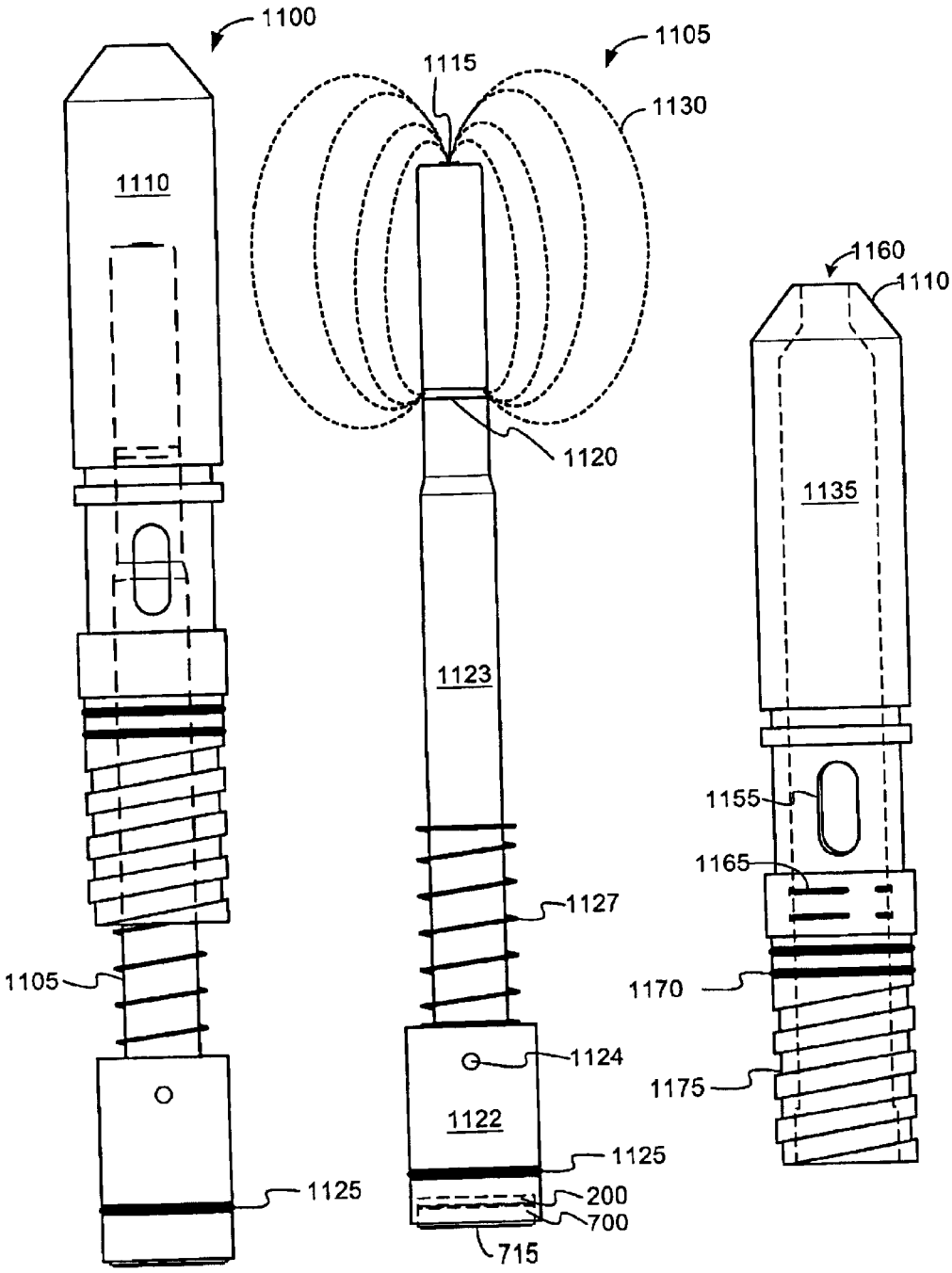
FIGS. 11A, 11B, and 11C depict an exemplary sensor assembly 1100 for use with some embodiments.

FIG. 11A depicts an exemplary sensor assembly 1100 for use with some embodiments. Sensor assembly 1100 has two major components, a conductivity sensor 1105 and a protective guard 1110. FIGS. 11B and 11C detail conductivity sensor 1105 and protective guard 1110, respectively.

Referring to FIG. 11B, in this example sensor 1105 measures the conductivity of e.g. water from a first platinum electrode 1115 to a second platinum electrode 1120. Electrodes 1115 and 1120 are connected to two conductors 210 (FIG. 2) of a wiring board 200 recessed in a connector support 1122. Electrodes 1115 and 1120 are supported in an insulating rod 1123 of e.g. Teflon™ joined to wiring board 200 via connector support 1122 and a pin or setscrew 1124. Sensor 1105 also includes a plastic band or O-ring 1125 and spring 1127, the purposes of which are explained below in connection with FIG. 13.

Sensor 1105 is shown with a plurality of lines 1130 representing parallel current paths from electrode 1115 to electrode 1120. The shape of current paths 1130 depends on the placement of sensor 1105. For example, some of the paths are altered if sensor 1105 is placed against the side of a well, and all paths may be changed with bore diameter. Guard 1110 (FIG. 1C) is thus designed both to facilitate insertion into a well, protect sensor 1105 and provide a fixed cavity 1135 that constrains the shape of paths 1130 to reduce measurement variations.

Sensor guard 1110 includes a window 1155 and a hole 1160 that together allow the fluid of interest to contact both electrodes 1115 and 1120. A pair of internal O-rings 1165 forms a watertight seal between the inside of guard 1110 and the outside of cylinder 1123. An additional pair of O-ring's 1170 and threads 1175 mate with a cylindrical component housing (see FIG. 13 and related text).

Figure 12A:
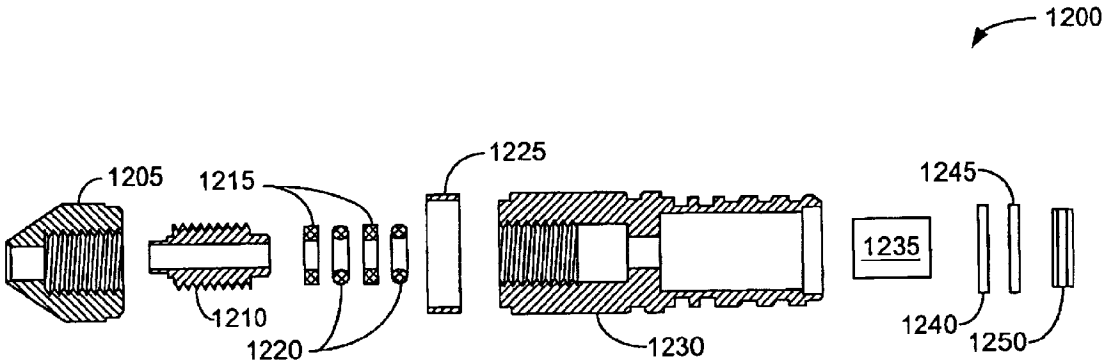
FIG. 12A is a cross-sectional exploded view of a cable assembly 1200 in accordance with one embodiment.

FIG. 12A is a cross-sectional exploded view of a cable assembly 1200 in accordance with one embodiment. Cable assembly 1200 includes an end cap 1205, a setscrew 1210, a pair of washers 1215, a pair of O-rings 1220, a band 1225, a cable body 1230, a cable retainer 1235, a wiring board 1240, a retainer 1245, and a piece of elastomeric conductor 1250 that extends through a slot (not shown) in retainer 1245. The materials used to form the various components of cable assembly 1200 differ for different applications. In one embodiment, cable cap 1205 is TEFLON, setscrew 1210, washers 1215, and ring 1225 are stainless steel, and cable body 1230 is KYNAR. An additional pair of O-rings 1262 and threads 1264 mate with a cylindrical component housing as explained below in connection with FIG. 13. Band 1225 can be used for decoration or labeling. Cable retainer 1235 should not have hard, sharp edges that might damage cable 1350. In one embodiment, retainer 1235 is soft polyethylene.

Figure 12B:
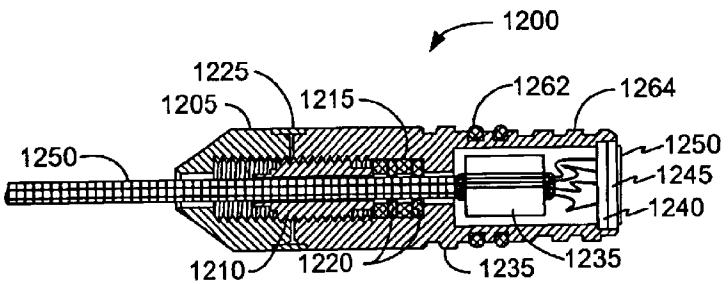
FIG. 12B depicts cable assembly 1200 assembled and including a cable 1250.
Figure 12C:
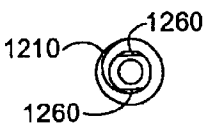
Figure 13A:
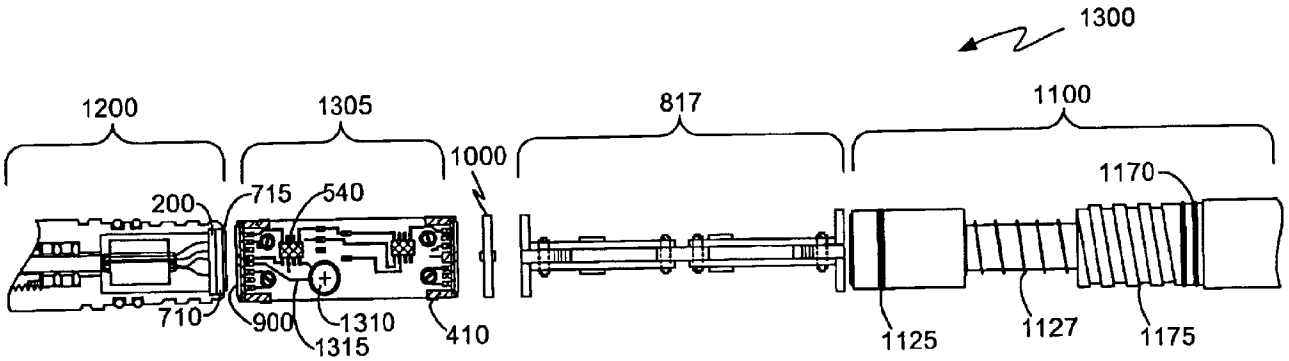
FIG. 13 is an exploded view of a sensor system 1300 in accordance with one embodiment.
Figure 13A:
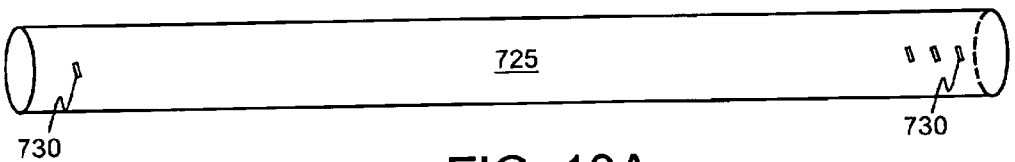

FIG. 12B depicts cable assembly 1200 assembled and including a cable 1250. Setscrew 1210 is tightened into cable body 1230 to compress O-rings 1220 against cable 1250, which provides a watertight seal. End cap 1205 is then threaded over exposed threads of setscrew 1210. The constituent conductors of cable 1250 extend through retainer 1235, loop around and back through retainer 1235, and are soldered to wiring board 1240, wiring board 200 of FIG. 2 in one embodiment. Conventional potting compounds can be added to the cavity in which retainer 1235 resides for improved water resistance and cable-pullout strength. External O-rings 1262 form a watertight seal with an associated housing, as depicted in FIG. 13. FIG. 12C depicts setscrew 1210 from the perspective of end cap 1205. One end of setscrew 1210 includes a pair of flats 1260 that mate with a conventional wrench during assembly.

FIG. 13 is an exploded view of a sensor system 1300 that includes various components, systems, and modules analogous to ones described above, like-labeled elements being the same or similar. A detailed discussion of above-described elements is omitted here for brevity.

Figure 13B:
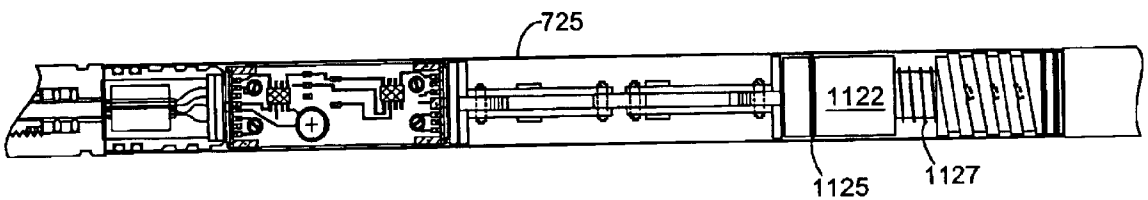

Sensor system 1300 illustrates how a pair of modules 1305 and 818 can be stacked between cable body 1200 and sensor assembly 1100 within a housing 725. When installed, as shown in FIG. 13B, spring 1127 of sensor assembly 1100 exerts a compressive force on the stack to establish the requisite electrical contact between opposing connectors. Spring 1127 may not be required if the various components within the stack are held to close tolerances.

Module 1305 is included to show how split ring connector 900 of FIG. 9 is used in accordance with one embodiment. Module 1305 includes a button-type battery 1310 with a positive terminal connected to component 540 via a pair of split pads, each of which is in electrical contact with split conductor 905 (FIG. 9). Due to the split, the positive power-supply terminal of battery 1310 remains disconnected from component 540 until the elastomeric conductor 715 of cable body 1200 is brought into contact with wiring board 900. At that time, the center conductor 205 of wiring board 200 (FIG. 2) of cable body 1200 provides a path for current between the halves of split conductor 905, and consequently between the positive power-supply terminal and component 540.

Other aspects of system 1300 are evident in FIG. 13B. For example, O-ring 1125 of sensor assembly 1100 is not a seal, but centers connector support 1122 within housing 725; the elasticity of O-ring 1125 allows support 1122 to bypass the interior protrusions corresponding to dimples 730.

The types of connections illustrated herein are illustrative and not limiting. For example, contact between opposing wiring boards may be accomplished without an elastomeric conductor, or with two or more elastomeric conductors. Further, each of the elements described in the foregoing figures can be made from various materials and by various methods. The selection of materials and manufacturing techniques, dictated chiefly by particular applications and economic considerations, are well within the ability of those of skill in the art.

While the present invention has been described in connection with specific embodiments, variations of these embodiments will be obvious to those of ordinary skill in the art. For example, the foregoing connector systems are not limited to ground- or surface-water applications, or even sensor applications. Still other variations will be readily apparent to those of skill in the art. Therefore, the spirit and scope of the appended claims should not be limited to the foregoing description.

What is claimed is:

1. A connector system comprising:

a. a first wiring board having:

i. a first wiring-board surface supporting a first plurality of conductors; and ii. a second wiring-board surface supporting a second plurality of conductors extending in a first plane;

iii. wherein at least one of the first plurality of conductors is electrically connected to a corresponding one of the second plurality of conductors;

b. a second wiring board having a third wiring-board; surface supporting a third plurality of conductors extending in a second plane substantially perpendicular to the first plane;

c. an elastomeric conductor disposed between the first and second wiring boards in contact with ones of the second plurality of conductors extending in the first plane and ones of the third plurality of conductors extending in the second plane substantially perpendicular to the first plane; and d. a support connected to the first and second wiring boards and holding the elastomeric conductor against the second and third wiring-board surfaces.

2. The connector system of claim 1, wherein the support clips to the first wiring board.

3. The connector system of claim 1, further comprising a third wiring board having a fourth wiring-board surface extending in parallel with the second plane and supporting a fourth plurality of conductors, wherein at least one of the fourth plurality of conductors electrically connects to at least one of the third plurality of conductors via the elastomeric conductor.

4. The connector system of claim 1, wherein the first plurality of conductors are concentric.

5. The connector system of claim 1, wherein the first wiring board further includes recesses receiving the support.

6. The connector system of claim 1, further comprising at least one fastener attaching the support to the second wiring board.

7. The connector system of claim 1, further comprising a second elastomeric conductor disposed against the first plurality of conductors.

8. The connector system of claim 7, further comprising a retainer disposed against the first plurality of conductors and supporting the second elastomeric conductor.

9. The connector system of claim 1, further comprising a housing encompassing the first and second wiring boards.

10. The connector system of claim 9, the housing including an interior protrusion, the first wiring board further comprising recesses providing clearance for bypassing the protrusion.

11. The connector system of claim 9, the housing including an interior protrusion, the first wiring board further comprising recesses providing clearance to bypass the protrusion.

12. The connector system of claim 9, further comprising a second conductor contacting the housing and at least one of the third plurality of conductors.

13. The connector system of claim 9, further comprising a second conductor contacting the housing and at least one of the third plurality of conductors.

14. The connector system of claim 13, wherein the second conductor is elastomeric.

15. The connector system of claim 13, wherein the support holds the second conductor against the housing.

16. The connector system of claim 13, wherein the second conductor is elastomeric.

17. A water monitoring system comprising:

a. a cylindrical component housing having a sensor end and a cable end;

b. a sensor assembly connected to the sensor end of the housing, the sensor assembly including a connector half; and c. a circuit module disposed within the housing and including:

i. a first wiring board having:

1) a first wiring-board surface supporting a first plurality of conductors in physical contact with the connector half of the sensor assembly; and 2) a second wiring-board surface supporting a second plurality of conductors, wherein at least one of the first plurality of conductors is electrically connected to a corresponding one of the second plurality of conductors;

ii. a second wiring board having a third wiring-board surface extending in a second plane substantially perpendicular to the first plane and supporting a third plurality of conductors;

iii. an elastomeric conductor disposed between the first and second wiring boards in contact with ones of the second and third pluralities of conductors; and iv. a support connected to the first and second wiring boards and holding the elastomeric conductor against the second and third wiring-board surfaces.

18. The connector system of claim 17, wherein the support clips to the first wiring board.

19. The connector system of claim 17, wherein the circuit module further includes a third wiring board having a fourth wiring-board surface extending in parallel with the second plane and supporting a fourth plurality of conductors, wherein at least one of the fourth plurality of conductors electrically connects to at least one of the second and third pluralities of conductors via the elastomeric conductor.

20. The connector system of claim 17, wherein the first plurality of conductors are concentric.

* * * * *

UNITED STATES PATENT AND TRADEMARK OFFICE

CERTIFICATE OF CORRECTION

PATENT NO. : 6,824,394 B1
DATED : November 30, 2004
INVENTOR(S) : Gary L. Brundage It is certified that error appears in the above-identified patent and that said Letters Patent is hereby corrected as shown below:

Column 8,
Line 9, claim 1 should read:
1. A connector system comprising:
a. a first wiring board having:
i. a first wiring-board surface supporting a first plurality of conductors; and
ii. a second wiring-board surface supporting a second plurality of conductors extending in a first plane;
iii. wherein at least one of the first plurality of conductors is electrcially connected to a corresponding one of the second plurality of conductors;
b. a second wiring board having a third wiring-board <;> surface supporting a third plurality of conductors extending in a second plane substantially perpendicular to the first plane;
c. an elastomeric conductor disposed between the first and second wiring boards in contact with ones of the second plurality of conductors extending in the first plane and ones of the third plurality of conductors extending in the second plane substantially perpendicular to the first plane; and
d. a support connected to the first and second wiring boards and holding the elastomeric conductor against the second and third wiring-board surfaces.

Signed and Sealed this

Thirteenth Day of September, 2005

JON W. DUDAS
*Director of the United States Patent and Trademark Office*